US006194678B1

(12) United States Patent
Yoshikawa et al.

(10) Patent No.: US 6,194,678 B1
(45) Date of Patent: Feb. 27, 2001

(54) PRESSURE SWITCH

(75) Inventors: Eiji Yoshikawa; Masahiro Tsugai; Toru Araki, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/567,007

(22) Filed: May 9, 2000

(30) Foreign Application Priority Data

Dec. 15, 1999 (JP) ..... 11-355937

(51) Int. Cl.[7] ..... H01H 35/34

(52) U.S. Cl. ..... 200/512; 200/181; 200/83 N; 200/83 V; 73/727

(58) Field of Search ..... 73/715, 727, 753, 73/754; 200/181, 81 R, 83 R, 83 B, 83 N, 83 V, 512

(56) References Cited

U.S. PATENT DOCUMENTS 4,965,415 * 10/1990 Young et al. ..... 200/83 N
5,277,067 * 1/1994 Holland et al. ..... 73/723
5,802,911 * 9/1998 Cahill et al. ..... 73/727
5,891,751 * 4/1999 Kurtz et al. ..... 438/53
6,122,974 * 9/2000 Sato et al. ..... 73/754

FOREIGN PATENT DOCUMENTS 6-267381 9/1994 (JP) ..... H01H/35/34
6-275179 9/1994 (JP) ..... H01H/35/34

* cited by examiner

*Primary Examiner*—Michael Friedhofer
(74) *Attorney, Agent, or Firm*—Leydig, Voit & Mayer, Ltd.

(57) ABSTRACT

A pressure switch with improved sealing of an airtight chamber, and improved electrical characteristics reducing chattering, increasing response rate, and minimizing the pressure necessary for activation. The pressure switch includes an upper substrate with a diaphragm readily deformed by an applied stress, a lower substrate overlapped with the upper substrate to form the airtight chamber, a contact electrically switched in response to the deformation of the diaphragm, and a sealing member continuously surrounding the airtight chamber, disposed between the first and second substrate, and hermetically sealing the airtight chamber.

20 Claims, 9 Drawing Sheets

PRESSURE SWITCH

BACKGROUND OF THE INVENTION

1) Technical Field of the Invention

This invention relates to a pressure switch with an airtight chamber partially defined by a diaphragm for electrically switching thereof in response to the stress applied to the diaphragm.

2) Description of Related Art

Some types of pressure switches have been so far proposed for a use of automobiles and industrial machines, in which a diaphragm of the pressure switch formed by partially thinning the semiconductor substrate is applied. Referring to FIGS. 16 through 18, the details of the conventional pressure switch disclosed in JPA06-267381, as an example, will be described hereinafter.

The conventional pressure switch 100 as shown in FIG. 16 basically comprises a silicon substrate 110 made of p-type single crystal and a glass substrate 130. The silicon substrate 110 includes, in its middle portion, a depression 111 formed on one surface (top surface), a recess 112 formed on the other surface (bottom surface) opposing to the depression 111, and a diaphragm 113 defined by and between the depression 111 and a recess 112 (with a thickness of several ten micrometers). The silicon substrate 110 further comprises a pair of p-type diffusion layers 114, 115, which are formed on the top surface, and spaced apart (electrically isolated) from each other through the depression 111. A pair of terminal electrode pads 116, 117 made of aluminum is also deposited on the top surface of the silicon substrate 110 for electrically connecting the pressure switch to the peripheral devices. A first wire layer 118 made of material such as aluminum is deposited on and extends along the diffusion layer 114 (left side), a side-wall, and a bottom of the depression 111.

On the other hand, the glass substrate 130 is joined on the top surface of the silicon substrate 110 so that an airtight chamber (reference pressure chamber) is defined between the depression 111 and the glass substrate 130. A second wire layer 131 also made of material such as aluminum is formed on a part of a bottom surface of the glass substrate 130 opposing the diffusion layer 115 (right side). The first and second wire layers 118, 131 are opposing each other within the airtight chamber 119, and each includes a contacting tip 120, 132 made of titanium, respectively. The diaphragm 113, when stressed, is deformed close to the glass substrate 130 so that the contacting tips 120, 132 contact each other so as to electrically connect the terminal electrode pads 116, 117 through the p-type diffusion layer 114, 115 and the wire layers 118, 131. Thus, the pressure switch can be switched in accordance with deformation (incurvature) of the diaphragm.

The silicon substrate 110 is designed to include a pair of offset paths 121, 133 pre-formed on the p-type diffusion layers 114, 115 for offsetting the thickness of the wire layers 118, 131 thereby to smoothen the joint surface where the silicon substrate 110 and the glass substrate 130 are joined together. In general, in order to achieve the high reliable pressure switch, the silicon substrate 110 and the glass substrate 130 should be hermetically sealed to define the airtight chamber 119, thereby maintaining its airtightness for a long time period.

SUMMARY OF THE INVENTION

Nevertheless, according to the above conventional pressure switch, the pre-formation of the offset path 122, 133 requires a precise control of the manufacturing process for the wire layers 118, 131 as well as the offset path 122, 133, so that both layers and paths have the same thickness. In fact, such control is too difficult to be achieved, and a high productivity can hardly expected especially in a mass production line.

Referring to the silicon substrate 110 as shown in FIG. 17, the diffusion layers 114, 115 are formed apart from each other via a region 122, in which the diffusion layer is not deposited. In general, a surface of the diffusion layer, when grown, is swelled by approximately one micrometer than the original surface so that a micro-step is formed between regions in which the diffusion layer is deposited and not. Therefore, the micro-step caused by the thickness of the diffusion layers 114, 115 as well as the thickness of the wire layers 118, 131 should be taken into consideration in order to smoothen the joint surface between the silicon substrate 110 and the glass substrate 130. Indeed, the glass substrate 130 is gapped apart from the silicon substrate 110 at the region 122 in which the diffusion layer is not deposited so that the pressure switch 100 is as shown in FIG. 18. This causes a problem deteriorating the airtightness of the airtight chamber 119 thereby to reduce the reliability of the pressure switch 100.

In addition to that, the formation of the contacting tips 120, 132 made of material such as titanium causes each a step-like boss at the overlapping portions of the contacting tips 120, 132 on the wire layers 118, 131, as clearly shown in FIG. 18. In general, the contacting tips 120, 132 should have the contacting surface as wide as possible in order to improve the electrical switching characteristics of the pressure switch 100, for instance, to reduce a resistance between the wire layers 118, 131, to minimize the chattering that is a noise vibration, and to optimize the deviation of pressure among pressure switches that is necessary for activating thereof. This would require that the step-like bosses of the contacting tips 120, 132 have complementary configurations each other, which is almost impossible to control to produce.

Further, as described above, the first wire layer 118 (left side) is formed on and extending along the diffusion layer 114 (left side), a side-wall and a bottom of the depression 111. The first wire layer 118 is bent at the portion between the top surface of the silicon substrate 110 and the side-wall of the depression 111, and at the portion between the side-wall and the bottom of the depression 111, thus the first wire layer 118 is easily broken at those bending portions.

Therefore, the present invention addresses the difficulties and problems as mentioned above. The first object of the present invention is to provide a pressure switch with an airtight chamber of which airtightness can be maintained for a long time period.

The further object of the present invention is to provide a pressure switch, which switches with less chattering at a higher response speed, and requires the minimized stress necessary for activating the pressure switches.

The pressure switch according to the first aspect of the present invention, comprises: a first substrate having a first opposing surface and a diaphragm capable of being readily deformed by a stress applied thereto; a second substrate having a second opposing surface overlapped with the first opposing surface of the first substrate to form an airtight chamber between the first and second substrate; a contact mechanism including, a first and second contact deposited within the airtight chamber and on the first opposing surface of the first substrate, a third contact deposited within the airtight chamber and on the second opposing surface of the second substrate, capable of being electrically connected with the first and second contact in response to the deformation of the diaphragm; and a sealing member continuously surrounding the airtight chamber, the sealing member disposed between the first and second opposing surface, thereby hermetically sealing the airtight chamber off the atmosphere.

The pressure switch according to the present invention, further comprises; a first and second conductive layer deposited on the first opposing surface of the first substrate, the first conductive layer being continuously surrounded by and spaced apart from the second conductive layer; and wherein the sealing member is the second conductive layer.

In the pressure switch according to the present invention, the first substrate is made of semiconductor material and the second substrate is made of glass.

The pressure switch according to the second aspect of the present invention, comprises: a first substrate having a first opposing surface and a diaphragm capable of being readily deformed by a stress applied thereto; a second substrate having a second opposing surface overlapped with the first opposing surface of the first substrate to form an airtight chamber between the first and second substrate; a contact mechanism including, a first contact deposited within the airtight chamber and on the first opposing surface of the first substrate, a second and third contact deposited within the airtight chamber and on the second opposing surface of the second substrate, capable of being electrically connected with the first contact in response to the deformation of the diaphragm; and a sealing member continuously surrounding the airtight chamber, the sealing member disposed between the first and second opposing surface, thereby hermetically sealing the airtight chamber off the atmosphere.

The pressure switch according to the present invention, further comprising: a first and second conductive layer deposited on the second opposing surface of the second substrate; and wherein the second and third contact deposited on the first and second conductive layer.

In the pressure switch according to the present invention, the first and second substrate are made of semiconductor material.

In the pressure switch according to the present invention, the sealing member includes a layer made of alkali glass.

In the pressure switch according to the present invention, the first substrate is made of semiconductor material, and the second substrate is made of glass.

The pressure switch according to the third aspect of the present invention, comprises: a first substrate having a first opposing surface and a diaphragm capable of being readily deformed by a stress applied thereto; a second substrate having a second and third opposing surface, the second opposing surface overlapped with the first opposing surface of the first substrate to form an airtight chamber between the first and second substrate; a contact mechanism including, a first contact on the first opposing surface of the first substrate, a second and third contact on the second opposing surface of the second substrate, capable of being electrically connected with the first contact in response to the deformation of the diaphragm; a third substrate having a fourth opposing surface overlapped with the third opposing surface of the second substrate; a sealing member disposed between the first and fourth opposing surface, continuously surrounding the airtight chamber, thereby hermetically sealing the airtight chamber off the atmosphere.

In the pressure switch according to the present invention, the second substrate includes a first wire member and a second wire member, and the first and second wire member is spaced away from each other, and wherein the second and third contact is disposed on the first and second wire member, respectively.

In the pressure switch according to the present invention, the first and second substrate is made of semiconductor and the third substrate is made of glass.

The pressure switch according to the present invention, further comprises a stiffening means disposed on the the diaphragm for stiffening a portion of the diaphragm adjacent to the first, second and third contact.

In the pressure switch according to the present invention, the diaphragm has a circular configuration.

In the pressure switch according to the present invention, the airtight chamber is filled with inert gas.

The pressure switch according to the present invention, further comprises a pair of terminal means electrically connected to the first and second conductive layer, respectively.

The pressure switch according to the present invention, further comprises a pair of terminal means electrically connected to the first and second wire member, respectively.

In the pressure switch according to the present invention, each of the first, second and third contact is substantially flat.

In the pressure switch according to the present invention, each of the first, second and third contact is made of gold.

In the pressure switch according to the present invention, the first substrate is high resistive.

The pressure switch according to the present invention, further comprises an insulating layer disposed on the first opposing surface.

Further scope of applicability of the present invention will become apparent from the detailed description given hereinafter. However it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

For a more complete understanding of the present invention and its advantages thereof, reference is now made to the following description taken in conjunction with the accompanying drawings, wherein like reference numerals represent like parts, in which:

FIG. 3 is the similar cross sectional view to that of FIG. 1 while the pressure switch is activated on;

FIG. 11 is a graph of the contacting resistance versus the time of the pressure switches according to Embodiment 1 and Modification 1 thereof, while the switches are activated on;

DETAILED DESCRIPTION OF THE PREFERRED EMBODIMENTS

Referring to the attached drawings, the details of embodiments according to the present invention will be described hereinafter. In those descriptions, although the terminology indicating the directions (for example, "upper", "lower", "right", and "left") are conveniently used just for clear understandings, it should not be interpreted that those terminology limit the scope of the present invention.

(Embodiment 1)

Figure 1:
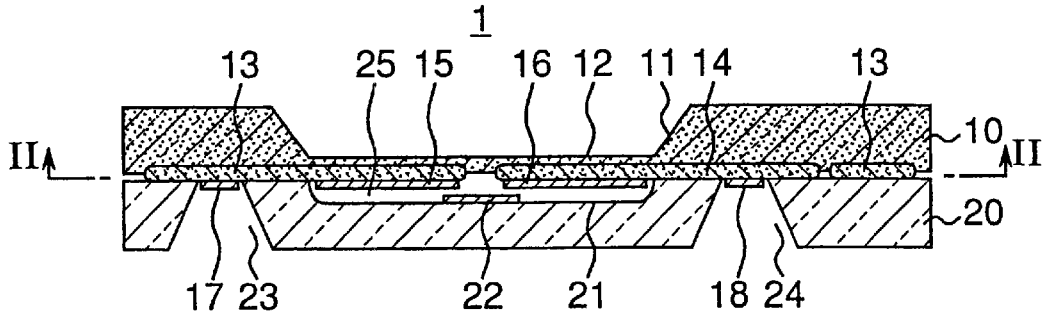
FIG. 1 is a cross sectional view of the pressure switch according to Embodiment 1 of the present invention.
Figure 2:
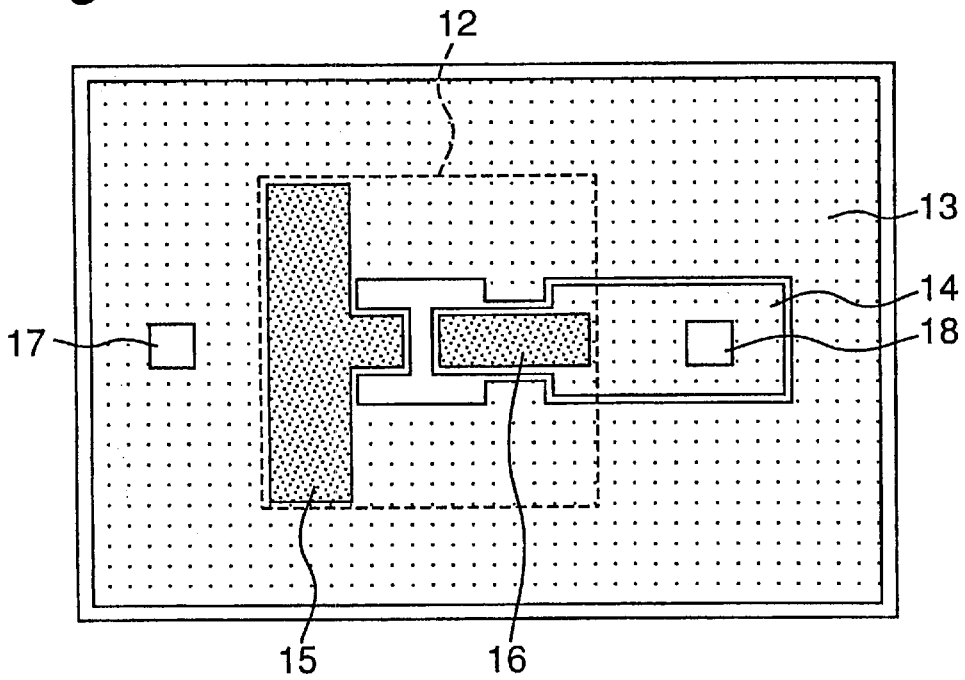
FIG. 2 is a cross sectional view taken along lines II—II in FIG. 1.
Figure 3:
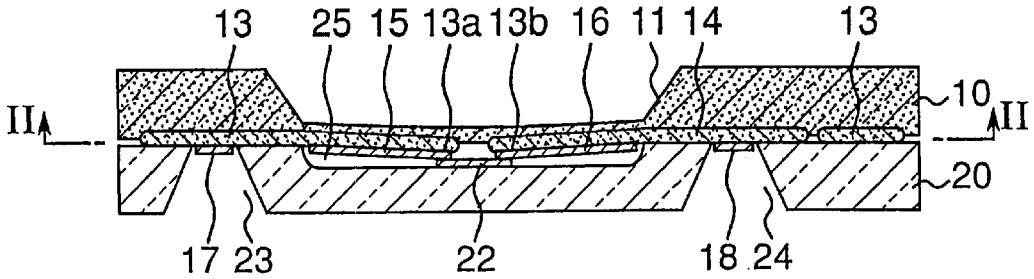

A pressure switch according to Embodiment 1 is described in FIGS. 1 and 2. As clearly shown in FIG. 1, the pressure switch 1 basically comprises an upper substrate 10 and a lower substrate 20 disposed beneath the upper substrate 10. The upper substrate 10 is a thin board with a predetermined thickness (for example, 250 through 400 $\mu$m) that is made of insulating material or high resistive semiconductor material. Also, the lower substrate 20 is a thin board with a predetermined thickness (for example, 250 through 400 $\mu$m) that is made of insulating material or high resistive semiconductor material. Preferably, the upper substrate 10 and the lower substrate 20 are made of silicon, and glass, respectively. However, the present invention should not be limited to those materials.

A middle portion of the upper surface of the upper substrate 10 is processed to form a recess 11 thereby having a thinned bottom portion, which defines a diaphragm 12. Although not specifically limited thereto, if the upper substrate 10 is made of silicon, any suitable etching processes may be used for forming the recess 11. The upper substrate 10 may be thinned before the etching process, if desired. The diaphragm 12 should have a thickness such that the diaphragm 12 is, when stressed and unstressed, easily deformed to the direction of the thickness (vertical direction in the drawing). The diaphragm 12 preferably has a thickness, for example, of several ten micrometers.

As particularly shown in FIG. 2, the first and second conductive layer 13, 14 are deposited on the lower surface of the upper substrate 10, so that the second conductive layers 14 is continuously surrounded by and spaced away from the first conductive layers 13. On the lower surface of the upper substrate 10 beneath the diaphragm 12 (as shown with a dotted line in FIG. 2), the first conductive layers 13 is extending from the left side and protruding to right side in the drawing, and the second conductive layers 14 is extending from the right side and protruding to left side in the drawing. Both protruding portions of the first and second conductive layers 13, 14 oppose each other approximately in the middle of the diaphragm 12 with some predetermined interval.

Although a various processes may be used for depositing the first and second conductive layer 13, 14 on the lower surface of the upper substrate 10, if the upper substrate 10 is made of n-type silicon, for example, those conductive layers 13, 14 may be advantageously formed by implanting or diffusing impurity such as boron into the silicon substrate thereby to grow the p-type diffusion layer (high impurity-doped layer). Each of those conductive layers 13, 14 has a portion within the diaphragm 12, on which low resistive and relatively soft metal (for example, gold) is laminated, so that a pair of movable contacts 15, 16 is formed. The movable contacts 15, 16 preferably have surfaces as wide as possible to contact over the wide surfaces with a fixed contact which will be described later, thereby reducing the resistance between the movable contacts 15, 16 through the fixed contact.

Each of those conductive layers 13, 14 has an another portion outside the diaphragm 12, on which low resistive and relatively soft metal (for example, gold) is laminated, so that a first and second terminal electrodes 17, 18 are formed, respectively.

Referring back to FIG. 1, the upper surface of the lower substrate 20 is processed by a known etching technology to form a depression 21 with a predetermined depth (for example, approximately 5 through 10 $\mu$m) in a region opposing to the diaphragm 12. The depression 21 has a bottom surface on which conductive metal (for example, gold) is laminated by a known thin-film laminating technology to form a fixed contact 22. The lower substrate 20 has a pair of holes 23, 24 bored in regions corresponding to the first and second terminal electrodes 17, 18 of the upper substrate 10.

The upper substrate 10 and the lower substrate 20 formed as described above, are bonded together by an appropriate bonding technology (for example, an anode-bonding technology) so that the depression 21 opposes to the diaphragm 12, and the first and second terminal electrodes 17, 18 are exposed by the pair of holes 23, 24, respectively. Thus, the depression 21 and the lower surface of the diaphragm 12 define an airtight chamber 25. Within the airtight chamber 25, the movable contacts 15, 16 are opposing to and spaced away from the fixed contact 22 with a predetermined gap. A switching contact mechanism is comprised of those contacts 15, 16, and 22.

As shown in FIG. 1, the conductive layers 13, 14 have their surfaces swelling with a certain thickness greater than the original silicon surface while formed by diffusing impurity into the silicon substrate. Therefore, when the lower surface of the upper substrate 10 is bonded to the lower surface 20, there will be a gap equivalent to the swelling thickness between the upper substrate 10 and the lower substrate 20. However, according to the present invention, the first conductive layer 13 continuously surrounds the second conductive layer 14, as described above (See FIG. 2). Therefore, the first conductive layer 13 continuously contacts with the upper surface of the lower substrate 20 thereby to hermetically seal the airtight chamber 25 off the atmosphere. Such hermetically sealing causes the airtight chamber 25 completely sealed off the atmosphere thereby to maintain its airtightness perfectly.

The first and second terminal electrode 17, 18 of the pressure switch 1 formed as described above are connected to a circuit to be switched. In this implementation, a stress applied to the diaphragm 12 (for example, mechanical stress or hydrodynamic pressure) deforms the diaphragm 12 to the direction of the lower substrate 20, resulting in contacting the movable contacts 25, 16 with the fixed contact 22, so that the first and second terminal electrode 17, 18 are electrically connected through the first and second conductive layers 13, 14, and the movable and fixed contacts 15, 16, 22. When the stress or pressure is released, the diaphragm 12 returns in a position as shown in FIG. 1 by its own elasticity, so that the movable contacts 13, 14 disconnect from the fixed contact 22.

(Embodiment 2)

Figure 4:
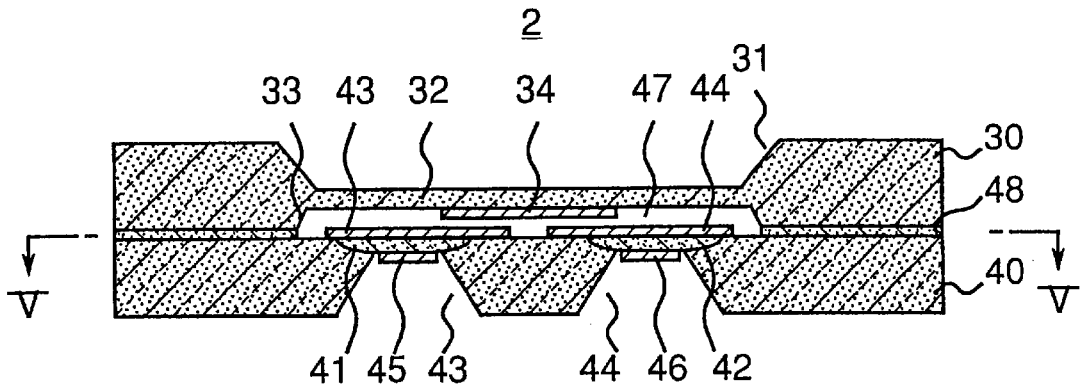
FIG. 4 is a cross sectional view of the pressure switch according to Embodiment 2 of the present invention.
Figure 5:
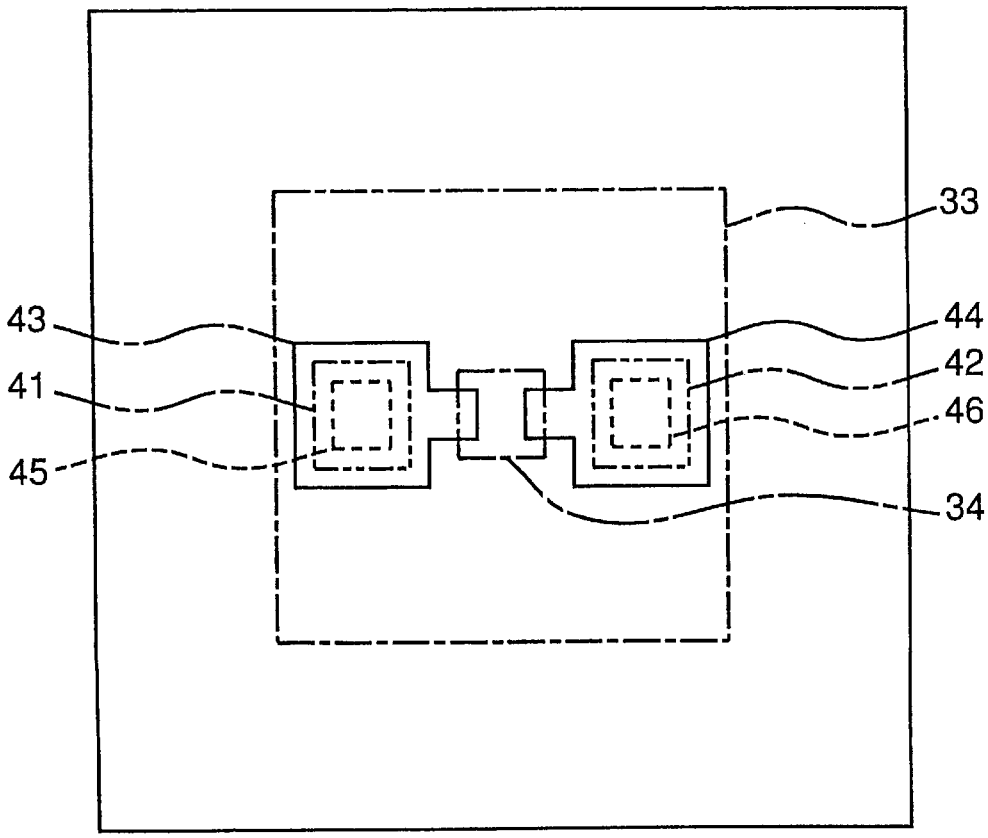
FIG. 5 is a cross sectional view taken along lines V—V in FIG. 4.

FIGS. 4 and 5 show a pressure switch 2 according to Embodiment 2. As clearly shown in FIG. 2, the pressure switch 2 basically comprises an upper substrate 30 and a lower substrate 40 disposed beneath the upper substrate 30. The upper substrate 30 is a thin board with a predetermined thickness (for example, 250 through 400 $\mu$m) that is made of insulating material or high resistive semiconductor material. Also, the lower substrate 40 is a thin board with a predetermined thickness (for example, 250 through 400 $\mu$m) that is made of insulating material or high resistive semiconductor material. Preferably, the upper substrate 30 and the lower substrate 40 are made of silicon. However, the present invention should not be limited to the material.

The upper substrate 30 is processed to form a recess 31 on the upper surface and a depression 33 on the lower surface, defining a thinned diaphragm 32 between the recess 31 and the depression 33. Although not specifically limited thereto, if the upper substrate 30 is made of single crystal silicon, any suitable etching processes may be used for forming the recess 31 and the depression 33. The upper substrate 30 may be thinned before the etching process, if desired. The diaphragm 32 should have a thickness such that the diaphragm 32 is, when stressed and unstressed, easily deformed to the direction of the thickness (vertical direction, in the drawing). The diaphragm 32 preferably has a thickness, for example, of several tens of micrometers. The depression 33 has a bottom surface on which conductive metal (for example, gold) is laminated by a known thin-film laminating technology to form a movable contact 34.

As particularly shown in FIG. 5, the lower substrate 40 has a region opposing to the recess 33, on which a first and second conductive layer 41, 42 are deposited. Those conductive layers 41, 42 are spaced away from each other. And those conductive layers 41, 42 may be formed by a similar process to that disclosed in Embodiment 1. Also, covered on those conductive layers 41, 42, is a pair of fixed contact 43, 44 made of conductive metal (for example, gold) opposing to the movable contact 34. The movable contact 34 and the fixed contacts 43, 44 together constitute the switching mechanism, and preferably have surfaces as wide as possible to minimize the resistance between the fixed contacts 43, 44 through the movable contact 34.

The lower surface of the lower substrate 40 is processed by a known etching process to form a pair of apertures 36, 37 exposing a portion of the first and second conductive layer 43, 44. Laminated on the exposed portions of the conductive layers 41, 42 are a first and second terminal electrodes 45, 46 made of metal such as gold.

The upper substrate 40 and the lower substrate 50 formed as described above are bonded by an appropriate bonding technique (for example, an nickel-silicide bonding technology) so that the fixed contacts 45, 46 of the lower substrate 40 oppose to the movable contact 34 of the upper substrate 30. The nickel-silicide bonding is performed, for example, by forming a Ti (titanium) layer as a base layer on a peripheral region of the lower surface of the upper substrate 30 made of silicon and an Ni (nickel) layer on the base layer, aligning the upper substrate 30 to the lower substrate 40, and then annealing the upper substrate 30 and the lower substrate 40 at approximately 400° C. Elements of Ni from the upper substrate 30 and Si from the lower substrate 40 form a bonding layer (an eutectic alloy) thereby to bond the upper substrate 30 and the lower substrate 40.

Thus, the recess 33 of the upper substrate 30 defines an airtight chamber 47 in conjunction with the upper surface of the lower substrate 40 opposing to the recess 33. Within the airtight chamber 25, the movable contact 34 is opposing to and spaced apart from the fixed contacts 43, 44 with a predetermined gap. Those contacts 34, 43, and 44 together constitute a switching contact mechanism. The first and second terminal electrodes 45, 46 are exposed through the apertures 36, 37, respectively.

Although each of the conductive layers 41, 42 and each of the fixed contacts 43, 44 covered thereon has a thickness, each of them is completely included within the airtight chamber 47 and none of them is interposed in a bonding surfaces of the upper substrate 30 and the lower substrate 40. Thus, the bonding surfaces are maintained even without such micro-steps. Also, in the bonding surfaces of the upper substrate 30 and the upper substrate 40, a bonding layer 48 continuously surrounds the airtight chamber 47. Therefore, the airtight chamber 47 can be completely sealed off the atmosphere.

The first and second terminal electrodes 45, 46 of the pressure switch 2 formed as described above are connected to a circuit to be switched. In this implementation, a stress applied to the diaphragm 32 (for example, mechanical stress or hydrodynamic pressure) deforms the diaphragm 32 to the direction of the lower substrate 40, resulting in contacting the movable contact 34 with the fixed contacts 43, 44, so that the first and second terminal electrode 45, 46 are electrically connected through the first and second conductive layers 41, 42, and the movable and fixed contacts 34, 43, and 44. When the stress or pressure is released, the diaphragm 32 returns in a position as shown in FIG. 4 by its own elasticity, so that the movable contact 34 disconnects from the fixed contacts 43, 44.

Figure 6:
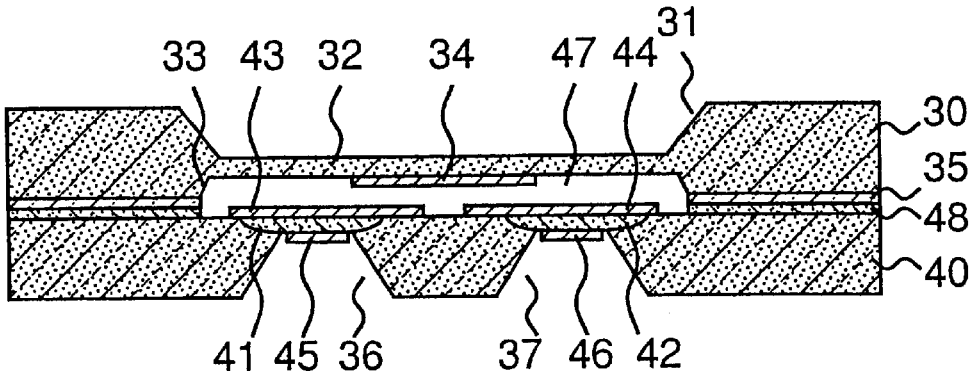
FIG. 6 is the similar cross sectional view of the pressure switch further including an insulating layer.

The upper substrate 30 may be alternatively made of low resistive silicon. However, in this application, an insulating layer 35 should be formed on the lower surface of the upper substrate 30 as shown in FIG. 6, preventing the fixed contacts 43, 44 from electrically connecting through the upper substrate 30.

(Embodiment 3)

Figure 7:
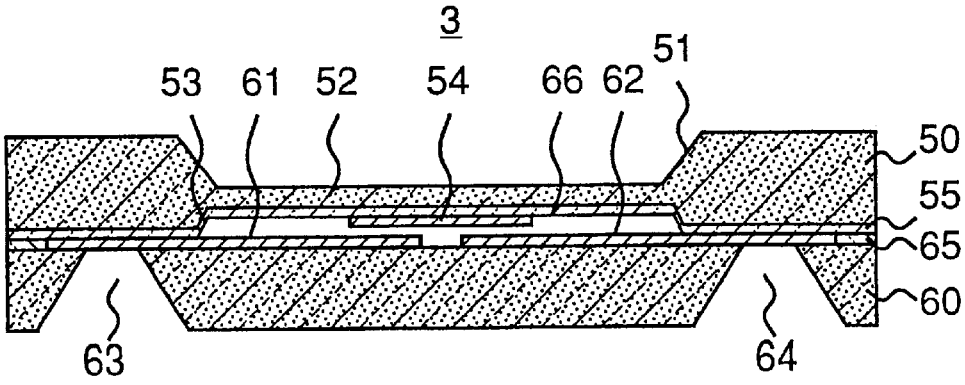
FIG. 7 is a cross sectional view of the pressure switch according to Embodiment 3 of the present invention.

FIG. 7 shows a pressure switch 3 according to Embodiment 3. As clearly shown in FIG. 7, the pressure switch 3 basically comprises an upper substrate 50 and a lower substrate 60 disposed beneath the upper substrate 50. The upper substrate 50 is a thin board with a predetermined thickness (for example, 250 through 400 $\mu$m) that is made of insulating material or high resistive semiconductor material. Also, the lower substrate 60 is a thin board with a predetermined thickness (for example, 250 through 400 $\mu$m) that is made of insulating material or high resistive semiconductor material. Preferably, the upper substrate 50 and the lower substrate 60 are made of silicon. However, the present invention should not be limited to the material.

The upper substrate 50 is processed to form a recess 51 on the upper surface and a depression 53 on the lower surface, defining a thinned diaphragm 52 between the recess 51 and the depression 53. Although not specifically limited thereto, if the upper substrate 30 is made of single crystal silicon, any suitable etching processes may be used for forming the recess 51 and the depression 53. The upper substrate 50 may be thinned before the etching process, if desired. The diaphragm 52 should have a thickness such that the diaphragm 52 is, when stressed and unstressed, easily deformed to the direction of the thickness (vertical direction in the drawing). The diaphragm 52 preferably has a thickness, for example, of several tens of micrometers. The depression 53 has a bottom surface on which conductive metal (for example, gold) is laminated by a known thin-film laminating technology to form a fixed contact 54.

As clearly shown in FIG. 7, a first and second fixed contacts 61, 62 are formed on the upper surface of the lower substrate 60, extending from the middle to the left edge and right edge of the lower substrate 60, respectively. Those fixed contacts 61, 62 are opposing to each other with a predetermined distance. The movable contact 54 on the upper substrate 50 is disposed on the lower substrate 60 such that the movable contact 54 opposes to the fixed contacts 61, 62. Those contacts 54, 61, and 62 together constitute a switching contact mechanism, and preferably have surfaces as wide as possible to contact over the wide surfaces thereby to reduce the resistance between the movable contacts 61, 62 through the fixed contact 54.

Also, the lower substrate 60 is processed by a known etching process to form a pair of holes for partially exposing the fixed contact 61, 62.

In addition, a bonding layer 65 is formed on the upper surface of the lower substrate 60 so that the bonding layer 65 continuously surrounds the fixed contact 61, 62. The bonding layer 65 may be made of, for example, alkali glass containing potassium ion and sodium ion and may be laminated, for example, by an electron beam evaporating, a sputtering, or a spin-on-glass technology with a use of a Pylex® glass. The bonding layer 65 has a thickness thicker at least than that of the fixed contacts 61, 62.

The bonding layer 65 as formed described above is then bonded to the lower surface of the upper substrate 50 so that an airtight chamber 66 is defined by the depression 53 of the upper substrate 50, the upper surface of the lower substrate 60 and the continuously surrounding bonding layer 65. Within the airtight chamber 66, the movable contact 54 is opposing to and spaced apart from the fixed contacts 61, 62 with a predetermined gap. Those contacts 54, 61, and 62 constitute a switching contact mechanism.

Although each of the fixed contacts 61, 62 has a thickness, since the bonding layer 65 with a thickness thicker than those of the fixed contacts 61, 62 continuously surrounds the fixed contacts 61, 62, the airtight chamber 66 can be completely sealed off the atmosphere with the perfect airtightness.

The first and second terminal electrode 61, 62 of the pressure switch 3 formed as described above are connected to a circuit to be switched. In this implementation, a stress applied to the diaphragm 52 (for example, mechanical stress or hydrodynamic pressure) deforms the diaphragm 52 to the direction of the lower substrate 60, resulting in contacting the movable contact 54 with the fixed contacts 61, 62. When the stress or pressure is released, the diaphragm 52 returns in a position by its own elasticity, so that the movable contact 54 disconnects from the fixed contacts 61, 62.

The upper substrate 50 may be alternatively made of low resistive silicon. However, in this application, an insulating layer 55 should be formed on the lower surface of the upper substrate 50 as shown in FIG. 7, preventing the fixed contacts 61, 62 from electrically connecting through the upper substrate 50.

(Embodiment 4)

Figure 8:
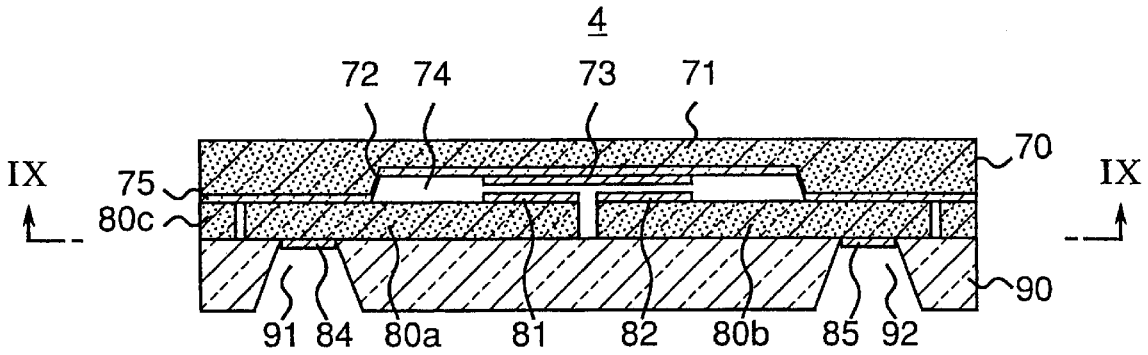
FIG. 8 is a cross sectional view of the pressure switch according to Embodiment 4 of the present invention.
Figure 9:
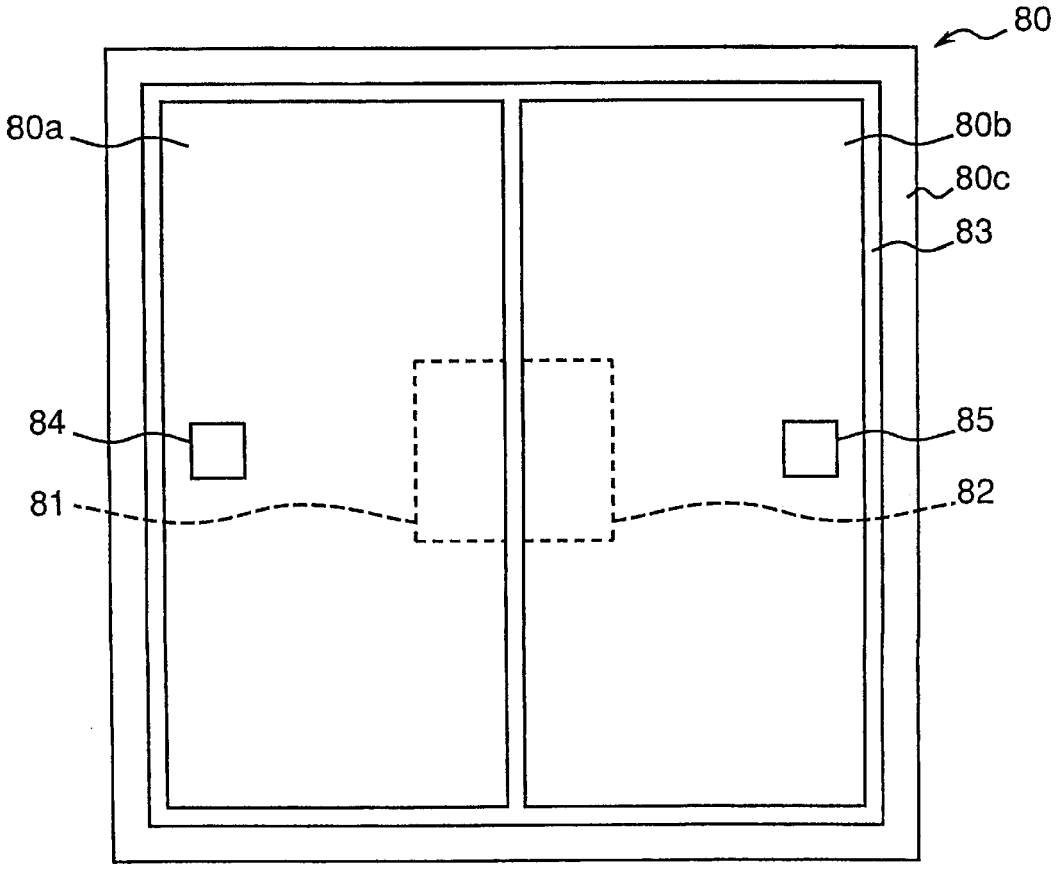
FIG. 9 is a cross sectional view taken along lines IX—IX in FIG. 8.

FIGS. 8 and 9 shows a pressure switch 4 according to Embodiment 4. As clearly shown in FIG. 8, the pressure switch 4 basically comprises an upper substrate 70, a middle substrate 80, and a lower substrate 90, in which the middle substrate 80 is interposed between the upper substrate 70 and the lower substrate 90. The upper substrate 70 is a thin board with a predetermined thickness (for example, 250 through 400 $\mu$m) that is made of insulating material or high resistive semiconductor material. The middle substrate 80 is made of low resistive semiconductor material with a predetermined thickness (for example, 250 through 400 $\mu$m). Also, the lower substrate 90 is a thin board with a predetermined thickness (for example, 250 through 400 $\mu$m) that is made of insulating material or high resistive semiconductor material. Preferably, the upper substrate 70 and the middle substrate 80 are made of silicon, and the lower substrate 90 is made of glass. However, the present invention should not be limited to the material.

As clearly shown in FIG. 8, the upper substrate 70 is processed to form a depression 72 (with a thickness of approximately 5 through 10 $\mu$m) on the lower surface, defining a diaphragm 71 in a thinned portion corresponding to the depression 72. Although not specifically limited thereto, if the upper substrate 70 is made of single crystal silicon, any suitable etching processes may be used for forming the depression 72. The diaphragm 71 should have a thickness such that the diaphragm 71 is, when stressed and unstressed, easily deformed to the direction of the thickness (vertical direction in the drawing). The diaphragm 32 preferably has a thickness, for example, of several ten micrometers. The depression 72 has a bottom surface on which conductive metal (for example, gold) is laminated by a known thin-film laminating technology to form a movable contact 73.

The middle substrate 80 has an upper surface on which a first and second fixed contacts 81, 82 made of conductive metal (for example, gold) are laminated opposing to the movable contact 73. The movable contact 73 and the fixed contacts 81, 82 together constitute the switching mechanism, and preferably have surfaces as wide as possible to minimize the resistance between the movable contacts 81, 82 through the fixed contact 73.

As clearly shown in FIG. 9, the middle substrate 80 is divided into three portions, that is, a first wire member 80*a* on which the first fixed contacts 81 is laminated, a second wire member 80*b* on which the second fixed contact 82 is laminated, and the peripheral sealing member 80*c* which continuously surrounds and is spaced apart from the first and second portion 80*a*, 80*b*. Thus, the first and second portion 80*a*, 80*b* and the peripheral sealing member 80*c* are divided to have a space 83 therebetween, so that those portions are electrically isolated one another. The middle substrate 80, when made of silicon, can be divided into three members 80*a*, 80*b* and 80*c* by, for example, etching the middle substrate 80 using the deep-dry etching technique after the middle substrate 80 is bonded on the upper substrate 70. This results in that the middle substrate 80 are divided into those members 80*a*, 80*b*, 80*c* with the dividing space 83. Further, a first and second terminal electrodes 84, 85 made of conductive metal (for example, gold) are deposited on the lower surface of the first and second members 80*a*, 80*b*, respectively.

Referring again to FIG. 8, the lower substrate 90 has a pair of holes 91, 92 which is opposing to and exposing to the first and second terminal electrode 84, 85, respectively.

The upper substrate 70, the middle substrate 80, and the lower substrate 90 are bonded together by an appropriate bonding technique (for example, anode-bonding technology) so that the movable contact 73 opposes to the fixed contacts 81, 82 with a predetermined distance, and the pair of apertures 91, 92 oppose to the first and second terminal electrodes 84, 85. Thus, an airtight chamber 74 is defined beneath the diaphragm 73 in accordance with the depression 73. Within the airtight chamber 74, the movable contact 73 is opposing to the fixed contacts 81, 82, and those contacts 73, 81, and 82 together constitute a switching contact mechanism. The first and second terminal electrodes 84, 85 are exposed through the holes 91, 92, respectively.

In this embodiment, although the airtight chamber 74 is connected to the dividing space 83, the dividing space 83 is completely surrounded by the lower surface of the upper substrate 70, the upper surface of the lower substrate 90, and the peripheral member 80*c*. Therefore, the airtight chamber 74 can be completely sealed off the atmosphere, thereby maintaining the airtightness perfectly.

The first and second terminal electrodes 84, 85 of the pressure switch 4 formed as described above are connected to a circuit to be switched. In this implementation, a stress applied to the diaphragm 71 (for example, mechanical stress or hydrodynamic pressure) deforms the diaphragm 71 in the direction of the middle substrate 80, causing the movable contact 73 in contact with the fixed contacts 81, 82, so that the first and second terminal electrode 84, 85 are electrically connected through the low resistive first and second wire members 80*a*, 80*b*, and the movable and fixed contacts 81, 82, and 73. When the stress or pressure is released, the diaphragm 71 returns in a position as shown in FIG. 8 by its own elastic nature, so that the movable contact 73 disconnects from the fixed contacts 81, 82.

The upper substrate 70 may be alternatively made of low resistive silicon. However, in this application, an insulating layer 75 should be formed on the lower surface of the upper substrate 70 as shown in FIG. 8, preventing the fixed contacts 81, 82 from electrically connecting through the upper substrate 70.

Each one of the airtight chambers as described above, is preferably filled with inert gas such as nitrogen and helium. Alternatively, the airtight chamber may be vacuated. Thus, contacts made of conductive material such as gold can be prevented from deteriorating and discharging with another contacts in accompanying with switching the pressure switch of the present invention.

(Modification 1)

A first modification according to Embodiments 1 through 4 of the present invention, in which the diaphragm is improved, will be described hereinafter with reference to FIGS. 10 through 14. Although FIGS. 10 through 14 are illustrated based upon Embodiment 1, it will be readily understood that such modification can be applied to other embodiments.

Figure 10A:
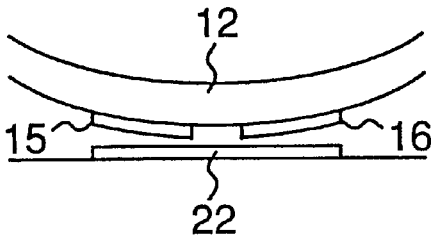
FIG. 10 is microscopic view of contacts of the pressure switches according to Embodiment 1 and Modification 1 thereof, at the moment the movable contacts is connecting with the fixed contact.

As described above, the pressure switch 1 according to Embodiment 1 of the present invention is switched on, when the diaphragm 12 is deformed by the stress or pressure to connect the movable contacts 15, 16 contact with the fixed contact 22. The diaphragm 12 is most greatly deformed on which the pressure is applied. And the stress is generally applied on the middle portion of the diaphragm 12. FIG. 10A shows a microscopic view of the diaphragm 12 at the moment the switch 1 is being switched on. Thus, contacting surfaces of the movable contacts 15, 16 contacting with the fixed contact 22 are very small at the beginning, and gradually expanded as the diaphragm is getting flat. When the movable contacts 15, 16 fail to contact entirely with the fixed contact 22 (i.e. when the contacting surfaces are small), the chattering, that is, a noise vibration between the movable contacts 15, 16 and the fixed contact 22 is easily caused by an unstable stress. Also, even where the stress is constantly applied to the diaphragm 12, as clearly shown by a dotted line in FIG. 11, it takes a certain time from a moment when the movable contacts 15, 16 first touch to the fixed contact 22 (at $t=T_0$) and a moment when the movable contacts 15, 16 contact thoroughly with the fixed contact 22 (at $t=T_1$). In other words, a certain time period from $T_0$ through $T_1$ is required to achieve the full-contact resistance of the pressure switch 1. As the pressure switch needs longer time period between $T_0$ through $T_1$ to have a full contact, the response of the pressure switch is slower, which should be improved.

Figure 10B:
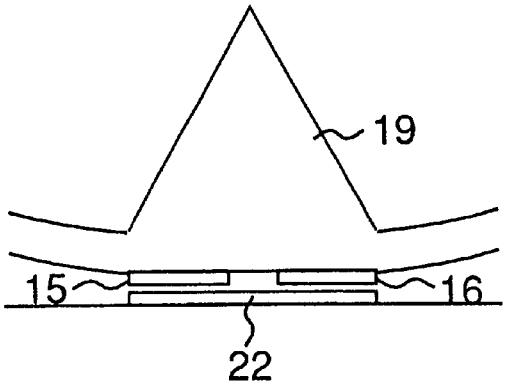
Figure 11:
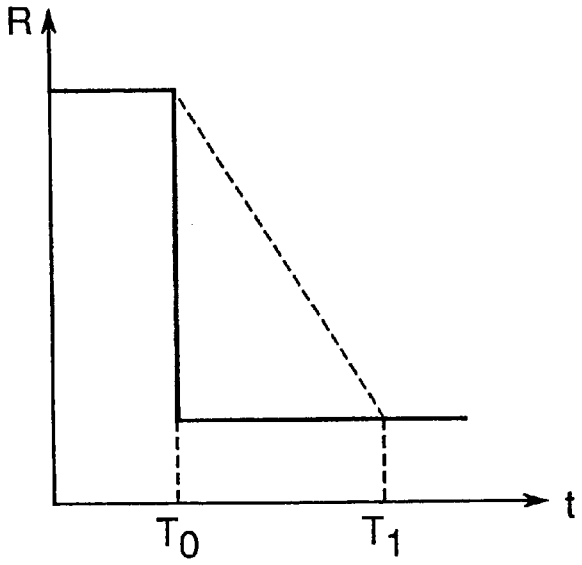

To address this problem, the middle portion of the diaphragm 12 is made less deformed by providing a ridge 19 around the middle portion of the diaphragm 12 thereby to stiffen the diaphragm 12 adjacent to the ridge 19. Referring to FIG. 10B also showing a microscopic view of the diaphragm 12 with the ridge 19 at the moment the switch 1 is being switched on, the movable contacts 15, 16 are readily maintained flat, and entirely contacted with the fixed contact 22. Furthermore, as shown by a real line in FIG. 11, the resistance of the pressure switch can be instantly reduced to the full-contact resistance. Thus, the pressure switch 1 having less chattering and high-speed response can be obtained.

Figure 12:
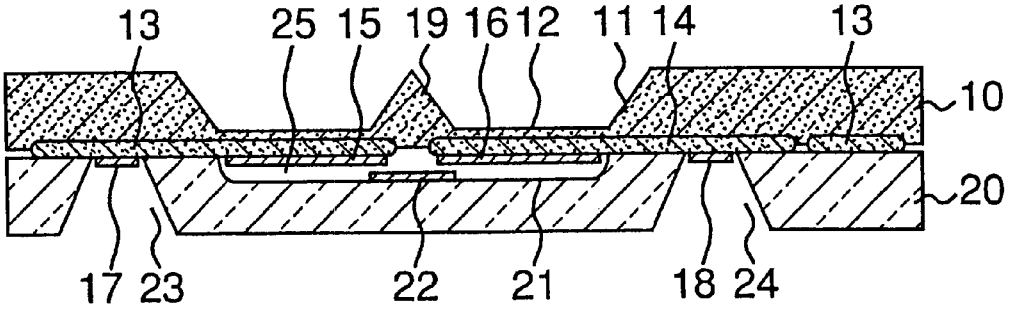
FIG. 12 is a cross sectional view of the pressure switch according to Modification 1 of Embodiment 1.
Figure 13:
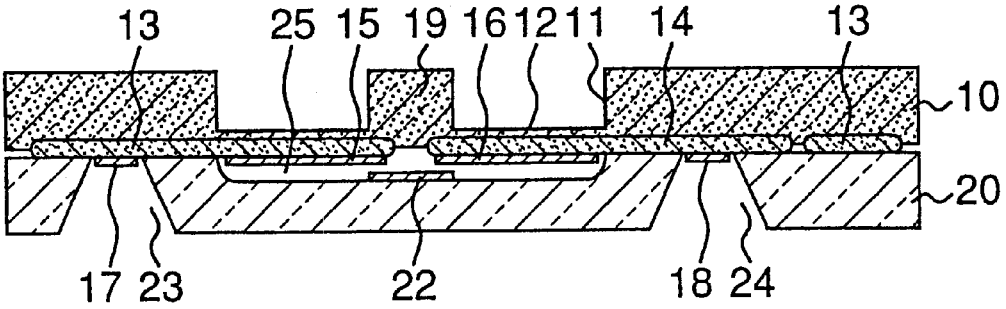
FIG. 13 is a cross sectional view of an another pressure switch according to Modification 1 of Embodiment 1.

FIG. 12 shows the ridge 19 as having a pyramid configuration or a conical configuration, the ridge 19 may have any configuration such as a cylinder or a cube as shown in FIG. 13, for stiffening the diaphragm 12.

Figure 14:
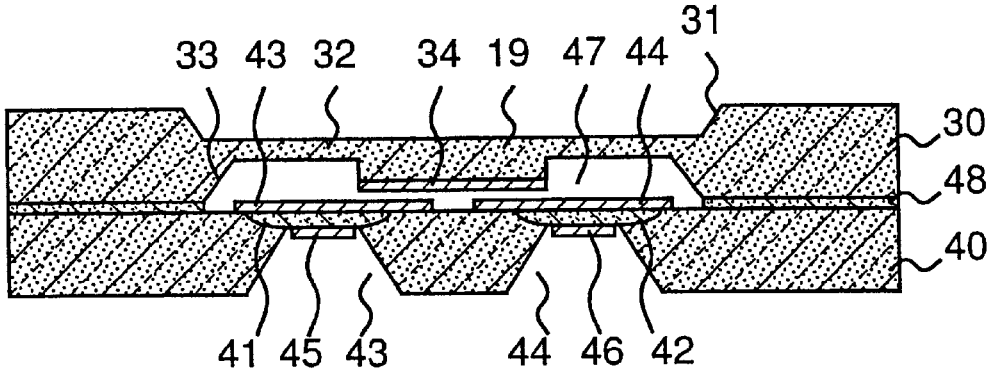
FIG. 14 is a cross sectional view of a further another pressure switch according to Modification 1 of Embodiment 1.

Further, although FIG. 12 shows the ridge 19 as being formed on the upper surface of the diaphragm 12 of Embodiment 1, the ridge may be formed on the lower surface of the diaphragm 32 and within the airtight chamber 47 to stiffen the diaphragm 32 as well, as shown in FIG. 14 for an another ridge according to Embodiment 2.

(Modification 2)

Figure 15:
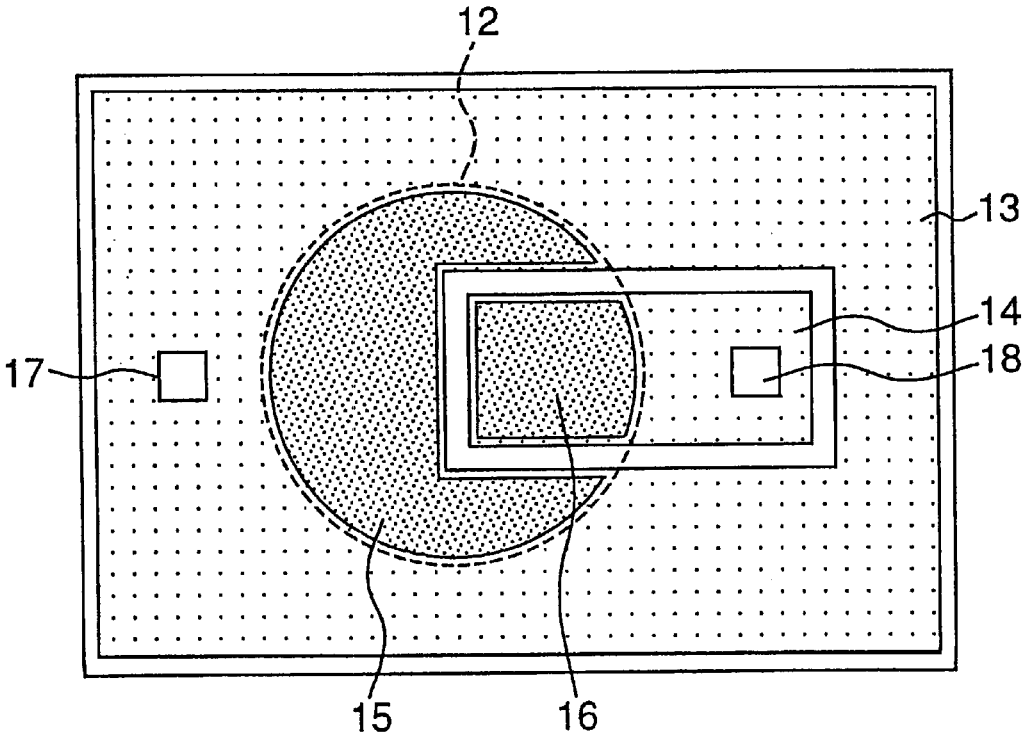
FIG. 15 is a cross sectional view of the pressure switch according to Modification 2 of Embodiment 1.
Figure 16:
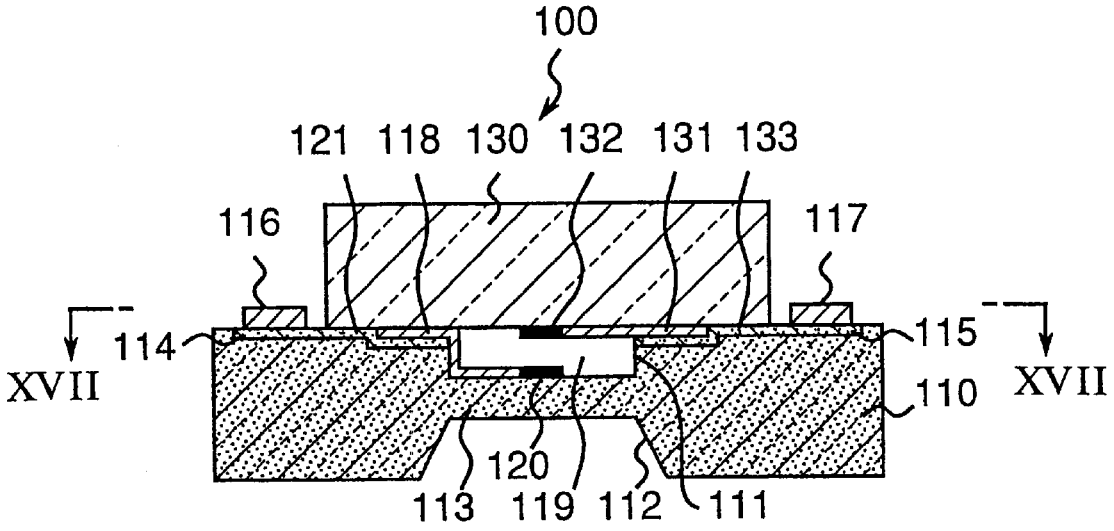
Fig.16 PRIOR ART
FIG. 16 is a cross sectional view of the conventional pressure switch.
Figure 17:
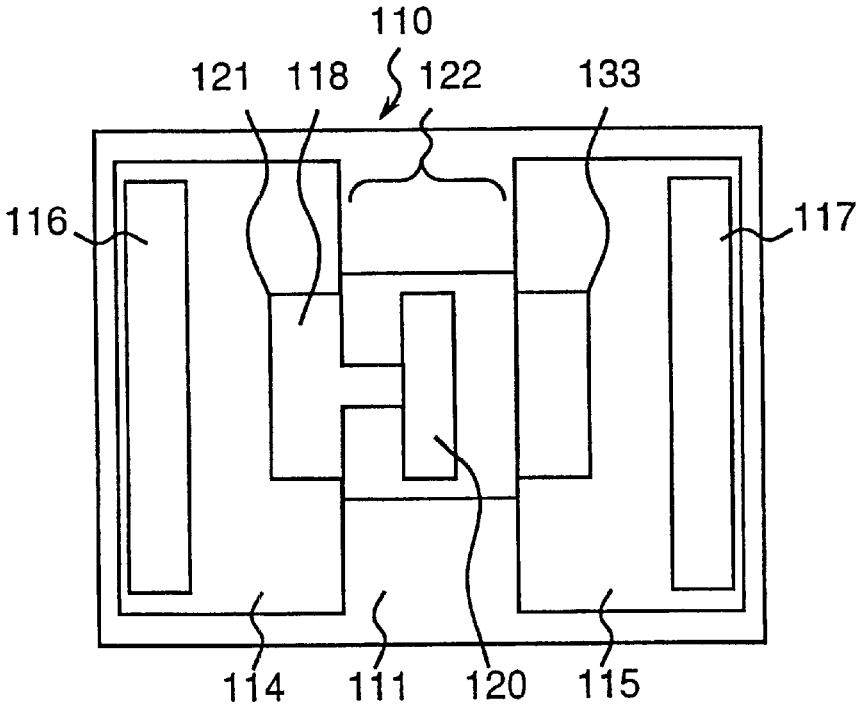
Fig.17 PRIOR ART
FIG. 17 shows a top surface of the silicon substrate taken along lines XVII—XVII in FIG. 16.
Figure 18:
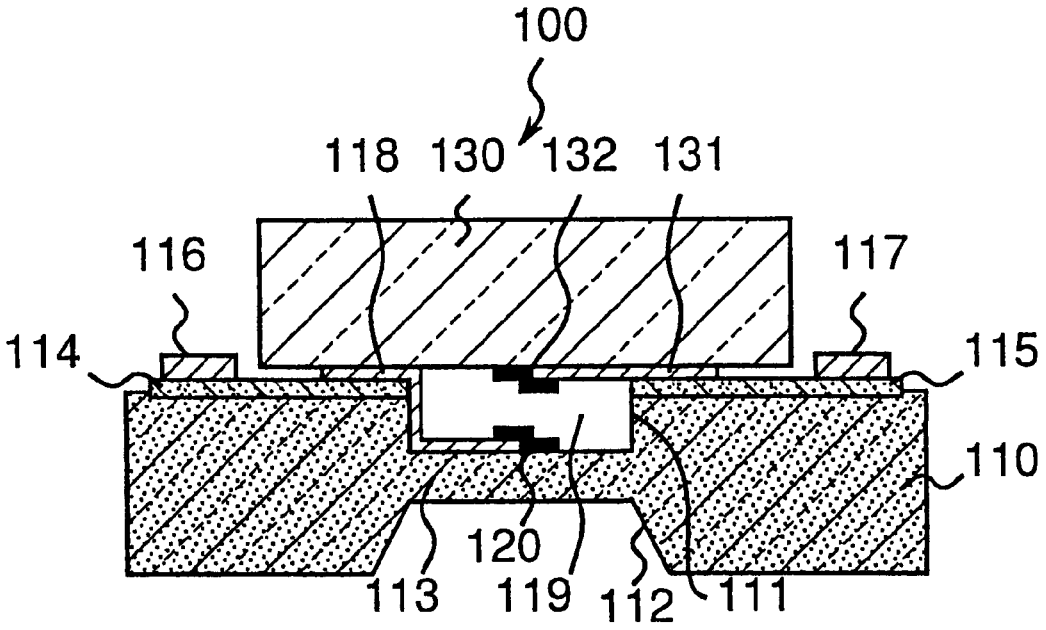
Fig.18 PRIOR ART
FIG. 18 is a cross sectional view of the conventional pressure switch.

A second modification according to Embodiment 1 to 4 of the present invention, in which the diaphragm is improved, will be described hereinafter with reference to FIG. 15. Although FIG. 15 is illustrated based upon Embodiment 1, it will be readily understood that such modification can be applied to other embodiments.

As described above, the pressure switch 1 according to Embodiment 1 of the present invention is switched on, when the diaphragm 12 is deformed by the stress or pressure so that the movable contacts 15, 16 contact with the fixed contact 22. In case where the diaphragm 12 has a top-view with a square configuration as shown in FIG. 1, the distance from the center to the edge of the diaphragm 12 varies depending upon the direction to the edge. Therefore, the tension also depends upon the position of the diaphragm 12, so that the diaphragm 12 is, in position, unevenly loaded, which is not favorable for the long-term reliability.

To solve this problem, the diaphragm 12 is designed to have a top-view with a circular configuration instead of the square configuration, so that the unevenness of the tensility (load) to the diaphragm 12 can be normalized thereby to achieve the robust and reliable pressure switch. In addition, the use of the circular diaphragm advantageously minimizes the stress for activating the pressure switch, in comparison with the stress for activating the pressure switch with the diaphragm having different configurations but the same dimension. In case where the most sensitive pressure switches capable of being activated with the minimized stress is required, such a pressure switch with the circular diaphragm is useful.

What is claimed is:

1. A pressure switch comprising:

a first substrate having a first opposing surface and a diaphragm readily deformed by an applied stress;

a second substrate having a second opposing surface overlapping the first opposing surface of said first substrate to form an airtight chamber between said first and second substrates;

a contact mechanism including, first and second contacts disposed within the airtight chamber and on the first opposing surface of said first substrate, a third contact disposed within the airtight chamber and on the second opposing surface of said second substrate, being electrically connected to the first and second contact in response to deformation of said diaphragm; and a sealing member continuously surrounding the airtight chamber, said sealing member being disposed between the first and second opposing surfaces, thereby hermetically sealing the airtight chamber from the atmosphere.

2. The pressure switch according to claim 1, further comprising first and second conductive layers on the first opposing surface of said first substrate, said first conductive layer being continuously surrounded by and spaced apart from said second conductive layer and wherein said sealing member includes said second conductive layer.

3. The pressure switch according to claim 2, wherein said first substrate is a semiconductor material and said second substrate is glass.

4. The pressure switch according to claim 2, further comprising a pair of terminal means electrically connected to said first and second conductive layers, respectively.

5. The pressure switch according to claim 1, further comprising stiffening means disposed on said diaphragm for stiffening a portion of said diaphragm adjacent to the first, second, and third contacts.

6. The pressure switch according to claim 1, wherein said diaphragm has a circular configuration.

7. The pressure switch according to claim 1, wherein the airtight chamber is filled with an inert gas.

8. The pressure switch according to claim 1, wherein each of the first, second, and third contacts is substantially flat.

9. The pressure switch according to claim 1, wherein each of the first, second, and third contacts is gold.

10. A pressure switch comprising:

a first substrate having a first opposing surface and a diaphragm readily deformed by an applied stress;

a second substrate having a second opposing surface overlapping the first opposing surface of said first substrate to form an airtight chamber between said first and second substrates;

a contact mechanism including, a first contact disposed within the airtight chamber and on the first opposing surface of said first substrate, second and third contacts disposed within the airtight chamber and on the second opposing surface of said second substrate, being electrically connected to the first contact in response to deformation of said diaphragm; and a sealing member continuously surrounding the airtight chamber, said sealing member being disposed between the first and second opposing surfaces, thereby hermetically sealing the airtight chamber from the atmosphere.

11. The pressure switch according to claim 10, further comprising first and second conductive layers disposed on the second opposing surface of said second substrate and wherein said second and third contacts are disposed on said first and second conductive layers.

12. The pressure switch according to claim 11, wherein said first and second substrates are semiconductor materials.

13. The pressure switch according to claim 12, wherein said first substrate is highly resistive.

14. The pressure switch according to claim 12, further comprising an insulating layer disposed on the first opposing surface.

15. The pressure switch according to claim 10, wherein said sealing member includes a layer of alkali glass.

16. The pressure switch according to claim 15, wherein said first substrate is a semiconductor material, and said second substrate is glass.

17. A pressure switch comprising:

a first substrate having a first opposing surface and a diaphragm readily deformed by an applied stress;

a second substrate having second and third opposing surfaces, the second opposing surface overlapping with the first opposing surface of said first substrate to form an airtight chamber between said first and second substrates;

a contact mechanism including, a first contact on the first opposing surface of said first substrate, second and third contacts on the second opposing surface of said second substrate, electrically connected to said first contact in response to deformation of said diaphragm;

a third substrate having a fourth opposing surface overlapped with the third opposing surface of said second substrate; and a sealing member disposed between the first and fourth opposing surfaces, continuously surrounding the airtight chamber, thereby hermetically sealing the airtight chamber from the atmosphere.

18. The pressure switch according to claim 17, wherein said second substrate includes a first wire member and a second wire member, and said first and second wire members are spaced apart from each other, and said second and third contacts are disposed on said first and second wire members, respectively.

19. The pressure switch according to claim 18, wherein said first and second substrates are semiconductor materials and said third substrate is glass.

20. The pressure switch according to claim 18, further comprising a pair of terminal means electrically connected to said first and second wire members, respectively.

* * * * *